United States Patent [19]

Freitag

[11] 3,977,752

[45] Aug. 31, 1976

[54] COAXIAL CABLE CONNECTOR

[76] Inventor: Wolfgang Freitag, Arndstr. 11, D-2351 Trappenkamp, Germany

[22] Filed: Jan. 28, 1975

[21] Appl. No.: 544,795

[52] U.S. Cl. ..... 339/95 A; 339/177 E

[51] Int. Cl.[2] ..... H01R 17/04

[58] Field of Search ..... 339/177 R, 177 E, 95; 174/75 C, 88 C, 89

[56] References Cited

UNITED STATES PATENTS

| | | | |
|---|---|---|---|
| 3,761,870 | 9/1973 | Drezin et al. | 339/177 R |

FOREIGN PATENTS OR APPLICATIONS

| | | | |
|---|---|---|---|
| 1,242,731 | 6/1967 | Germany | 339/177 R |
| 1,903,398 | 9/1969 | Germany | 339/177 R |

*Primary Examiner*—Roy Lake
*Assistant Examiner*—Neil Abrams

[57] ABSTRACT

This invention relates to electrical connectors for coaxial cables of the kind in which the connector comprises an inner contact member having resilient fingers to hold the inner cable conductor, which latter is held in an insulating body coaxially to an outside contact conductor, pressure fingers being provided to project into a tapering pressure means and said fingers being capable of being pressed radially inwards against the resilient fingers aforementioned by means of a pressure member. This pressure member is displaceable under the axial force exerted by a member such as a screw cap used for securing the connector in relation to the cable. The pressure fingers have protuberances arranged for bearing against the free resilient fingers when the connector is secured. The protuberances may be domed or ridge-shaped.

13 Claims, 6 Drawing Figures

COAXIAL CABLE CONNECTOR

BACKGROUND OF THE INVENTION

The present invention relates to electrical connectors acting as a termination such as a plug or part of a union for a co-axial cable whereby such cable may be connected to a piece of equipment or to another cable having a counterpart connector terminating it.

In the art, the term "coaxial cable" signifies a cable comprising an inner conductor usually of stranded wire, although it may be a single relatively thick inner filament, and an outer conductor, generally in the form of a braided screen sheath concentric with and surrounding said inner conductor, an insulating sheath being interposed between the inner and outer conductors. More particularly the invention relates to such connectors in which an inner contact member, which has resilient fingers to hold the inner conductor of the cable, is held in an insulating body co-axially to an outer contact conductor of the connector, and in which are provided pressure fingers which project into a tapering pressure means and which are capable of being pressed radially inwards against the resilient fingers by means of a pressure member which is displaceable under the axial force exerted by a member used for securing the connector. Hereinafter such connectors will be referred to as "connectors of the kind described".

In a known electric connector of the kind described, the pressure fingers on the insulating body extend axially and on the side nearer the resilient fingers they are so formed that on this side they press uninterruptedly against the particular resilient finger involved for the whole of their length. Further, the free ends of the resilient fingers have on the outside part-conical faces against which is applied a tapering surface in a pressure bush. The pressure bush is urged axially in the direction of the pressure fingers by the axial force exerted by a screw cap which is arranged to be screwed onto the outer sleeve of the connector. In this way the pressure fingers are subjected to a force which operates radially inwards, the effect of which, when the inner conductor of the cable has been inserted, is to press the pressure fingers against the conductor so as to produce electrical contact. In addition, the pressure fingers, which are made of a plastics material, project past the free ends of the resilient fingers on the inner contact member, these free ends having sharp edges at their outer periphery which dig into the pressure fingers.

Since the electrical contact between the resilient fingers and the inner conductor of the cable is generally formed at the free ends of the resilient arms, it happens when the pressure fingers become worn, i.e. when impressions are created in the pressure fingers by the sharp peripheral edges of the resilient fingers, that the electrical contact becomes too small and thus inadequate. Added to this is the fact that the force transmitted from the pressure bush to the pressure fingers is weakened in its capacity as a compressive force on the resilient fingers because it is distributed over the whole area of contact between the spring fingers and the pressure fingers, with the result that the only pressure generated is a relatively weak one distributed over an area which fails to ensure that the inner conductor of the cable is securely clamped under all circumstances, particularly when the pressure fingers are worn and/or the screw cap is not done up sufficiently tightly.

It is an object of the invention to provide a connector of the kind described for co-axial cables whose diameters may vary over a wide range. Further objects include the provision of such a connector which is simple, and cheap to produce, quick to attach to the service device, which can be clamped to the inner conductor of the cables without screwing, and in which a secure electrical contact between the conducting parts of the connector and the conductors of the coaxial cable is always ensured.

SUMMARY OF THE INVENTION

These and other objects are achieved by providing the pressure fingers, on the side nearer the resilient fingers and preferably at their free ends, with a protuberance which bears against the free resilient fingers when the connector is secured. By virtue of this, the compressive force exerted by the pressure fingers, which is directed radially inwards, is always transmitted to the resilient fingers in a specific, substantially linear region which extends in a circumferential direction. In this way the relatively high compressive force which exists in the pressure fingers is in all cases transferred to the resilient fingers undiminished, as a result of which good and firm contact is ensured between the resilient fingers and the inner conductor of the cable even when the connector is used repeatedly and no matter what the application. This is particularly advantageous when a coaxial cable with a thin inner conductor is clamped by the connector after it has been used on a coaxial cable having a thick inner conductor.

In one particular embodiment of the invention where, at least when the inner conductor is clamped between the resilient fingers, said fingers form, in their longitudinal direction, an area of closest proximity where the contact with the inner conductor is produced, the protuberances, which are preferably rounded, make contact with the resilient fingers away from this area of closest proximity.

The improvement which is achieved in this way lies in the fact that the contact at the point where the resilient fingers touch the inner conductor is strengthened due to the fact that there is a gap, firstly between the area of contact between the resilient fingers and the pressure fingers, and secondly between the resilient fingers and the inner conductor, as a result of which a certain lever action is set up against the said touching point which is responsible for the strengthening.

Furthermore, the known plug of the kind described, and referred to above, has as its outer contact conductor a continuous, stamped and rolled metal sleeve which terminates in a truncated cone which tapers in the direction of the cable to be connected. Since the truncated cone comes into place between the pressure fingers mentioned and the screw cap, the end of the sleeve nearer the cable has longitudinal slots to allow it to yield inwards. When a coaxial cable is connected to the plug, the outer conductor of the cable, which is spread out into a cone-shape, is clamped between the outer face of the truncated cone and the conical pressure face in the screw cap.

This method of construction has the disadvantage that when the cable is being clamped by the connector, the screw cap first of all has to be removed from the plug and threaded onto the end of the cable. Furthermore, if the stamped one-piece outer contact conductor of the plug is rolled, it is not possible to produce on it an insertion portion for insertion into a socket or the like which is perfectly round, with the result that the connection between the plug and the socket is deficient from both the mechanical and the electrical points of view. Therefore the outer contact conductor of the connector should be so formed that it has an insertion portion which is perfectly round, and it should in addition be cheap to produce.

Thus, when the connector is of a type in which a stamped and rolled clawed sleeve is used in it to produce the outer conductive path, in which case the claws, which are curved and arch towards the axis of the sleeve, are pressed against the outer conductor of the coaxial cable which is to be connected by the conical internal pressure face in the screw cap, it is improved by having its outer contact conductor consist, in the section at the insertion end, of a short, turned sleeve, while the remaining part nearer the cable is formed by the stamped and rolled clawed sleeve.

In this way it is only necessary for the screw cap to be slackened to allow the end of the cable, which has bben stripped, to be inserted in the plug, and the end can then be clamped solidly, simply by tightening up the screw cap. In this way the cap does not need first of all to be unscrewed and threaded onto the end of the cable. Furthermore, the relatively short end-part of the outer contact conductor of the connector which is inserted into the socket or the like is produced in the form of a turned part and it can therefore be made perfectly round and of accurate diameter with a view to achieving a mechanically and electrically satisfactory plug-in connection. However, since turned parts are comparatively expensive to produce, the section of the sleeve which forms the outer contact conductor at the end nearer the cable is cheaply produced in the form of a stamped and rolled clawed sleeve, with the shell of the clawed sleeve enclosing circumferentially the major proportion of the insulating body which holds the inner conductor.

BRIEF DESCRIPTION OF THE DRAWINGS

Further objects and advantages of the invention will become apparent from a reading of the ensuing description in conjunction with the accompanying drawings which illustrate a number of embodiments thereof by way of example and in which.

DETAILED DESCRIPTION OF PREFERRED EMBODIMENTS

Figure 1:
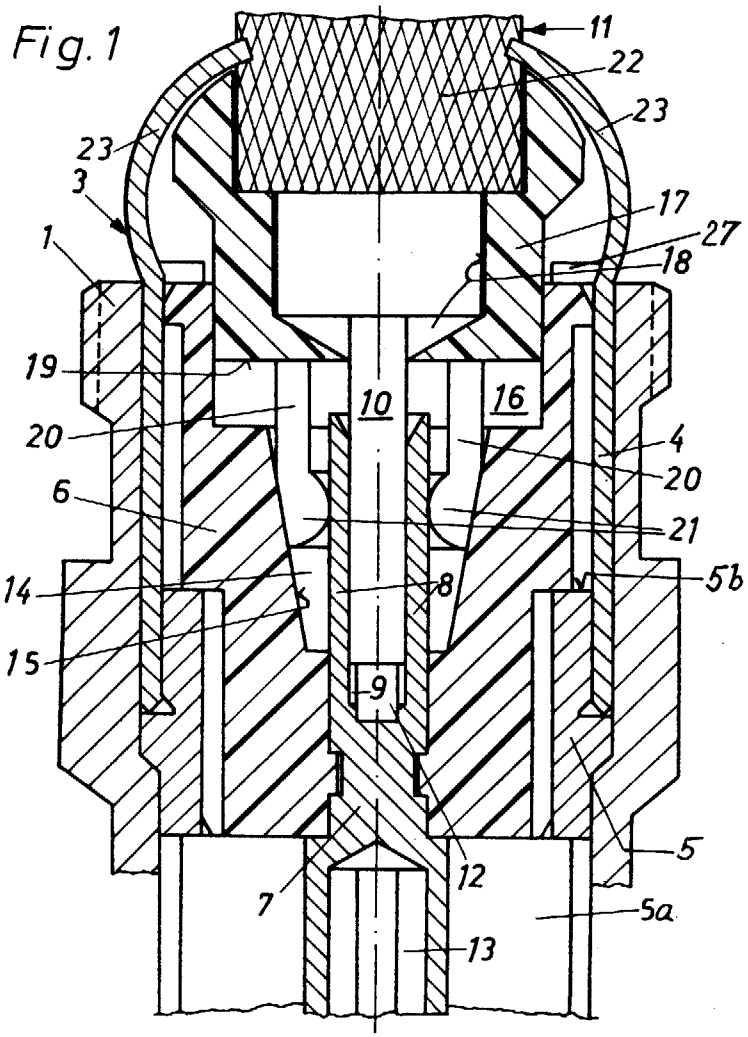

Referring to the drawings, as shown in FIG. 1, the electrical connector according to the invention, which may be produced both as a plug and also as part of a union, includes an outer sleeve 1, which is preferably composed of a plastics material and onto which can be screwed a screw cap 2 (FIG. 4), which is also advantageously composed of a plastics material. In the outer sleeve is mounted the outer contact conductor 3 of the connector, which is made up of a clawed sleeve 4 and a turned sleeve 5, which conjointly enclose a first insulating body 6, which holds a central inner contact member 7, and a second insulating body 17. The inner contact member 7 consists of a turned metal part and at the end nearer the cable it has two resilient fingers 8, which are produced by providing this end of the inner contact member (which has a central bore 9 to receive the inner conductor 10 of a coaxial cable 11) with a continuous, transverse, axial slot 12. The end 13 of the inner contact member 7 on the insertion side is formed in the conventional way as a socket as the embodiment shown in this Figure is intended to serve as the female half of a complete union.

The first insulating body 6 has an axial recess 14 which surrounds the inner contact member 7, at a distance and so that the contact is central therein. The recess 14 is in the form of a bore which widens out conically in the direction of that end of the connector which is nearer the cable, the conical peripheral walls 15 of the bore being used as a conical pressure face, as will become evident. The conical bore 14 continues into a cylindrical bore 16 in the insulating body 6, in which the second insulating body 17 is mounted so as to be axially displaceable. This second insulating body has a central axial bore 18 which widens out in step towards the end of the union half nearer the cable and which is intended to receive the stripped end of the coaxial cable 11. That end face 19 of the second insulating body 17 which faces towards the tapering bore 14 in the first insulating body 6 has two integral pressure fingers 20 which project unconfinedly and of which the outline shape in radial cross-section is partly semi-circular. These fingers project axially into the tapering bore 14 and part of their rear faces rests against the tapering pressure face 15 in bore 14. Preferably at their free ends and on the side nearer the resilient fingers 8, the pressure fingers have a protuberance 21 which rests against the resilient fingers and which is advantageously rounded or domed. When the prepared end of the coaxial cable 11 has been inserted in the half of the union, to clamp the whole coaxial cable securely in place the screw cap 2 is tightened up hard on the outer sleeve 1. This is shown for purposes of comparison in FIG. 4 since the screw cap is omitted in FIG. 1 to reduce drawing work. In this way the pressure fingers 20 penetrate into the pressure taper 15 and at the same time move radially inwards towards the resilient fingers 8 and press them against the inner conductor 10 of the coaxial cable 11. The outer conductor 22 of the coaxial cable 11, which has been folded back, is connected electrically to the outer contact conductor 3 of the union half by virtue of the fact that the claws 23 engage firmly in the outer conductor of the cable due to the axial force exerted by the screw cap 2. At the same time this axial force also slides or presses the second insulating body 17, and thus the pressure fingers 20, into the half-union axially when the screw cap is tightened.

Figure 2:
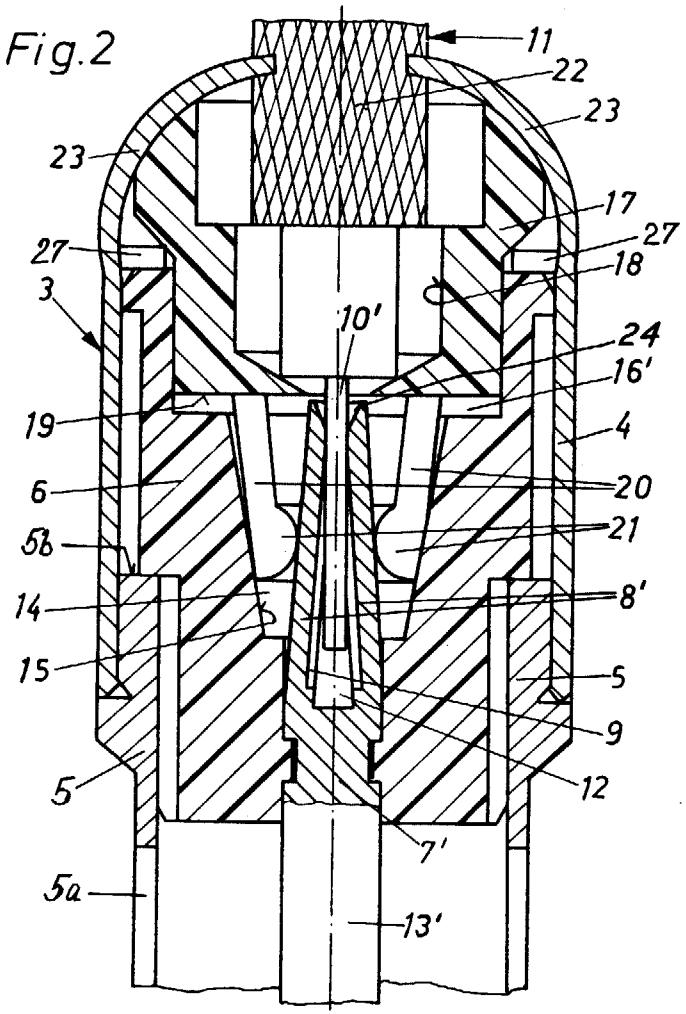
FIGS. 1 to 4 show axial sections through first, second, third and fourth embodiments respectively of coaxial connection according to the invention.

FIG. 2 shows substantially the same embodiment as that shown in FIG. 1, with the exception that the socket end 13 of the inner contact member 7 is formed as a conventional pin since in this case the connector according to the invention is constructed as a plug or male half of a union. Also, the outer sleeve 1 and the screw cap 2 are omitted to reduce drawing. The major difference however lies in the fact that when a coaxial cable 11 having a slender inner conductor 10 is inserted between the resilient fingers on the inner contact member, the plane in which the protuberances 21 on the pressure fingers 20 make circumferential linear contact with the resilient figures 8 is situated away from the circumferential area of contact between the free ends of the resilient fingers and the inner conductor 10 of the cable, at which point the clamped electrical contact is formed, with the result that the free ends of the resilient fingers press elastically against the inner conductor 10, which improves the electrical contact which exists with slender inner conductors at this point where the resilient fingers are in closest proximity.

Figure 3:
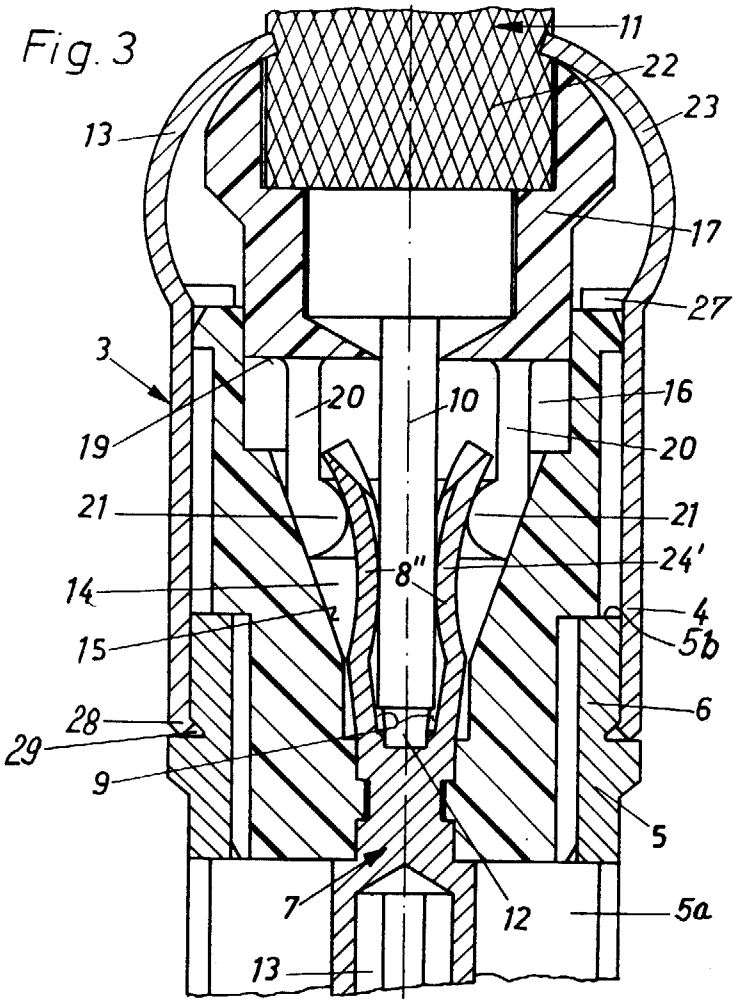

The embodiment shown in FIG. 3 corresponds to the embodiment shown in FIG. 1 except that the free ends of the resilient fingers 8 are modified. The sections of the two resilient fingers nearer their free ends are made of a curved configuration such that the sides curve towards one another. In this way the two resilient fingers have, in any spread or clamped position, an area of closest proximity 24 and the protuberances 21 on the pressure fingers 20 generally engage against the resilient fingers at some point away from this point of closest proximity, thus ensuring that the resilient fingers are applied in a more satisfactory way against the inner conductor which is to be clamped by the connector. In the instance illustrated, the inner conductor shown clamped in position is a thick one and it can be seen that the protuberances 21 engage against the resilient fingers before the area of closest proximity 24 is reached, with the result that the compressive force operating against the inner conductor 10 is further strengthened by virtue of a lever effect, it being possible for the resilient fingers to yield elastically in the region remote from their free ends.

Figure 4:
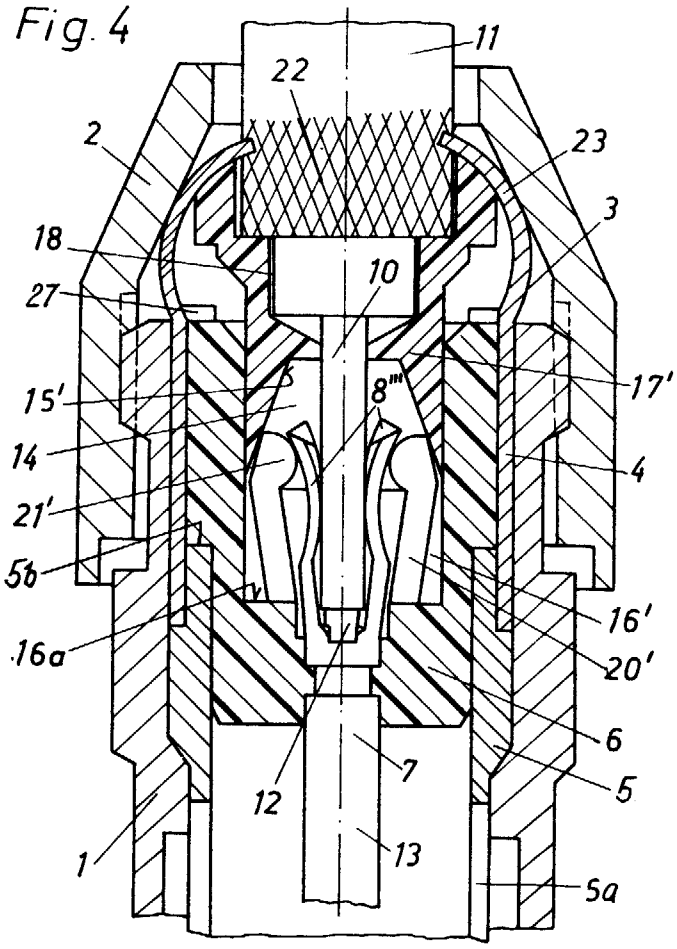

The further embodiment shown in FIG. 4 is shown substantially in its entirety and differs from the embodiments previously described in that the pressure fingers 20 are arranged on the first insulating body 6 while the tapering bore 14 which contains the pressure face 15 is provided in the second insulating body. The cylindrical bore 16 in the first insulating body 6 extends nearly to the bottom of the resilient fingers 8 and the pressure fingers 20 are situated at the bottom **16*a* of bore 16 and are continuous with body 6 and extend axially. Their length is such that the protuberances 21 on them engage against the terminal areas of the resilient fingers, the fingers being of the same configuration as in the embodiment shown in FIG. 3. It is clear that in this case the compressive force exerted by the pressure fingers 20 against the inner conductor 10 of the cable is in all cases strengthened by virtue of the lever effect already mentioned. In this embodiment the pressure fingers perform a purely radial movement, while the pressure taper 15 moves axially, when the second insulating body 17 is shifted axially inwards by the screw cap 2**.

In the embodiments described the pressure fingers 20 are all substantially the same, as has already been explained in connection with FIG. 1, and since two diametrically opposed resilient fingers 8 are provided in each of the embodiments described, two pressure fingers also are provided in each case and these too are diametrically opposed. However, it is also possible for a plurality of, i.e. more than two, resilient fingers to be provided together with a corresponding number of pressure fingers. In addition, the second insulating body 17 is, in all the embodiments, made proof against falling out by the claws 23 on the clawed sleeve 4 should the screw cap 2 come unscrewed for any reason.

Figure 6:
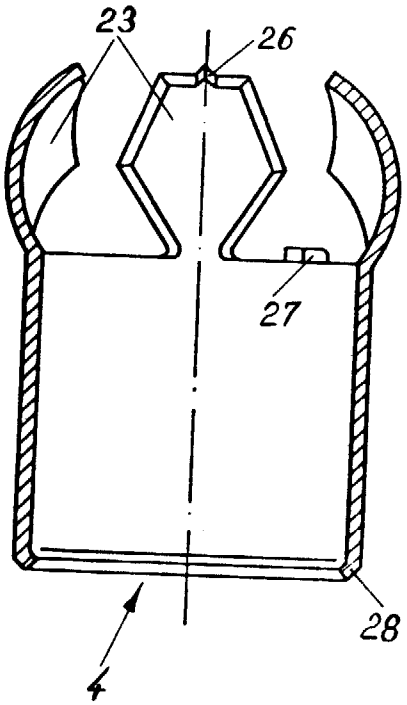
FIG. 6 shows this part of the outer contact conductor after it has been formed into a clawed sleeve from the stamping.
Figure 5:
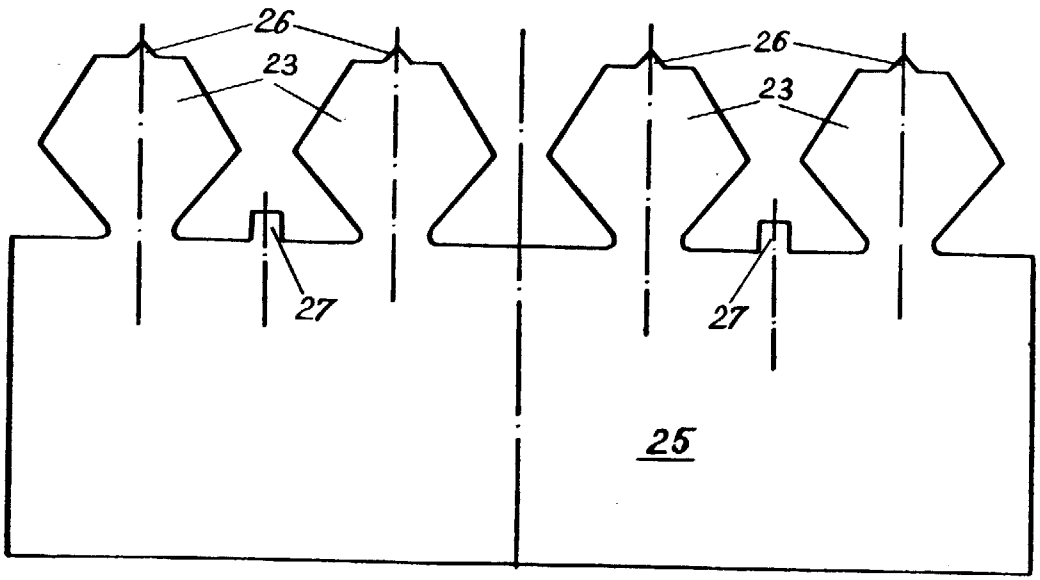
FIG. 5 shows a stamping used to form part of the outer contact conductor of the connector.

FIGS. 5 and 6 show an improved clawed sleeve 4. This clawed sleeve, which also forms the outer contact conductor 3 of the connector, encloses the major portion of the outer contact conductor at the end nearer the cable and also encloses the major proportion of insulating body 6. It is produced in the normal way as a stamped part and is then rolled into the shape of a sleeve, the spoon-like claws 23 (FIG. 6), which curve in towards the longitudinal axis of the sleeve, having at their free ends teeth 26 which come to a point and which engage in the outer conductor 22 of the cable and in the insulating sheath around the inner conductor of the cable. Also provided on the sleeve 4 are tabs 27 which may be folded over radially inwards and which locate insulating body 6 axially. Advantageously the clawed sleeve is folded over inwards at the edge 28 remote from the claws 23 and this edge engages in a circumferential groove 29 in the turned sleeve 5 (FIGS. 1 to 3). Alternatively, a simple abutment shoulder may be provided on the turned sleeve 5 in place of the circumferential groove 28 to support the clawed sleeve axially (FIG. 4).

The shorter section of the outer contact conductor 3 of the connector, which is at the insertion end, is in the form of a short, turned sleeve 5 (FIGS. 1 to 4), as a result of which the inserted portion **5*a* of the sleeve 5 can be made perfectly round and of an accurate diameter, which can be done with precision in the latter. The turned sleeve also has a shoulder 5*b* to support the first insulating body 6 axially. Because of the configurations shown and described for the clawed sleeve 4 and the turned sleeve 5, the advantages of both of these are combined so as to enable a cheap and accurately fitting outer contact conductor 3** to be produced, while at the same time the sleeves hold together all the parts which are mounted in them. Also, means are provided in the usual way to prevent the components of the connector from turning relatively to one another.

The process of clamping the stripped end of a coaxial cable to connectors as described above, will now be explained. After the screw cap 2 has first been loosened, the end of the cable is inserted in the connector, after which the screw cap is tightened up hard. When this is done the screw cap presses against the claws 23 on the clawed sleeve 4 and as a result these are moved inwards. This movement has both a radial component, as a result of which the folded-back outer conductor of the cable is clamped in, and an axial component, as a result of which the second insulating body 17 is moved axially inwards. This insulating body, in conjunction with the tapering pressure surface 15, then presses the pressure fingers 20 against the resilient fingers 8 of the inner contact member 7, as a result of which the inner conductor of the coaxial cable is clamped in position. To facilitate the axial movement of the second insulating body 17, it is provided, at the end facing the claws, with a preferably spherical shoulder surface 30 which matches the curvature of the claws and against which the claws are applied.

I claim:

1. In an electrical connector for use with coaxial cables having inner and outer conductors of electrically-conductive material, the connector having an inner contact member which includes resilient fingers opposing one-another adapted to hold the inner conductor therebetween securably, an outer contact member, and a first insulating body separating and mounting the inner and outer contact members coaxially to one-another, said insulating body being shaped and adapted to define a tapering recess space with tapering walls thereof converging radially inwardly toward said resilient fingers, insulating structure mounted on a terminal end of the coaxial cable, and pressure means mounted securably onto the insulating structure and providing pressure fingers opposing one-another adapted to be inserted into said tapering recess space into pressing contact with the tapering walls such that when the pressure fingers become flexed radially inwardly as a result of being pressed against the tapering walls, the pressure fingers becomes pressed against said resilient fingers to flex thereby the resilient fingers inwardly to anchor and grasp the inner conductor, said outer contact member being adapted for connection to the outer conductor of the cable.

2. A connector of claim 1, in which said pressure fingers include at distal portions thereof, protuberances positioned such that the protuberances bear against said resilient fingers to thereby flex the resilient fingers inwardly when the pressure fingers are moved axially into said tapering recess space and into pressing contact with said tapering walls.

3. A connector according to claim 2, wherein, at least when the inner conductor of the cable is clamped between them, said resilient fingers conjointly form an area of closest proximity where the contact with the inner conductor of the cable is produced, and wherein said protuberances make contact with said resilient fingers away from said area of closest proximity.

4. A connector according to claim 2, wherein said protuberances are domed.

5. A connector according to claim 1, wherein said insulating structure is mounted to be axially displaceable in said first insulating body and has a stepped, central, axial bore to receive a stripped end of the coaxial cable.

6. A connector of claim 5, wherein said pressure fingers are arranged to project unconfinedly from an end face of said insulating structure which is nearer said resilient fingers on said inner contact member and extend into the tapering recess which substantially surrounds said resilient fingers.

7. A connector according to claim 6, wherein said pressure fingers enclose said resilient fingers with a small gap therebetween and said pressure fingers are provided with said protuberances and are of such length that said protuberances engage said resilient fingers adjacent the free ends thereof.

8. A connector of claim 6, wherein said first insulating body has a cylindrical recess adjacent and in communication with said tapering recess space, which cylindrical recess formed in the first insulating body is adapted to guide the insulating structure during an axial insertion of said pressure fingers into said tapering recess.

9. A connector of claim 6, wherein said outer contact means is constituted by a clawed sleeve forming curved claws, said claws arching toward the axis of said sleeve and being pressed against the outer conductor of the coaxial cable and which said insulating structure is adapted for axially inward movement by said curved claws on said clawed sleeve and has a spherical shoulder surface which is matched to the curvature of said claws.

10. A connector according to claim 9, wherein said claws on said clawed sleeve have teeth which come to a point and which engage in the outer conductor of the cable, and wherein said clawed sleeve has tabs which are bendable in a radially inward direction to locate said first insulating body axially.

11. A connector according to claim 10, wherein the section of said outer contact conductor at the insertion end consists of a short turned sleeve, while the remaining section at the cable end is formed by said clawed sleeve.

12. A connector according to claim 11, wherein said turned sleeve has first shoulder means to support said first insulating body axially, and second shoulder means to support said clawed sleeve axially.

13. A connector according to claim 12, wherein the said turned sleeve is circumferentially grooved and the circumferential edge of said clawed sleeve remote from said claws, which is folded over inwards, engages in said circumferential groove in said turned sleeve.

* * * * *